United States Patent [19]

Greest

[11] 3,948,362

[45] Apr. 6, 1976

[54] PERSONAL SAFETY EQUIPMENT

[75] Inventor: Thomas Charles Greest, Selsdon, England

[73] Assignee: Barrow Hepburn Equipment Limited, London, England

[22] Filed: Apr. 23, 1975

[21] Appl. No.: 570,965

[30] Foreign Application Priority Data

Dec. 12, 1974 ,United Kingdom..... 53852/74

[52] U.S. Cl...... 188/65.2; 24/115 L; 182/5; 182/191

[51] Int. Cl.[2]..... A47L 3/04

[58] Field of Search..... 188/65.1, 65.2, 67; 182/5, 182/6, 7, 191; 74/531; 24/115 R, 115 B, 115 F, 115 G, 115 L, 115 M

[56] References Cited

UNITED STATES PATENTS

| | | | |
|---|---|---|---|
| 3,177,543 | 4/1965 | Fountain | 24/115 L |
| 3,317,971 | 5/1967 | Meyer | 182/5 |
| 3,335,469 | 8/1967 | Shand et al. | 188/65.1 |

*Primary Examiner*—Trygve M. Blix
*Assistant Examiner*—Sherman D. Basinger
*Attorney, Agent, or Firm*—Cushman, Darby & Cushman

[57] ABSTRACT

A safety device comprising a runner which can be threaded onto a suspended safety line and houses a linegripping member movable between an unlocked condition and a locked condition and an operating member which provides externally of the runner an attachment point for a personal safety belt and is operatively associated with the line-gripping member to cause movement thereof towards locked condition responsive to sudden downward acceleration of the attachment point; with the improvement that the operating member comprises first and second link members pivotally attached to the runner, and a bar member pivotally connected to the link members to form a parallel linkage, and that the attachment point is disposed at least as high as the level of the top of the runner housing when the runner is oriented for use on a vertical line with the operating mechanism in its runner-free position. The linkage is preferably movable so that such attachment point is below the level of the linegripping members when the runner is in locked condition. Movement of the line-gripping member is preferably actuated by one or more cams located on a the link member.

10 Claims, 3 Drawing Figures

PERSONAL SAFETY EQUIPMENT

The invention relates to personal safety devices for use by workers at height.

A conventional form of safety equipment for use by personnel exposed to the risk of falling from considerable height comprises a personal safety belt or harness to which one end of a safety line is attached, the other end of the safety line being provided with a safety hook which can be engaged with a fixed anchorage. This equipment is satisfactory so long as a suitable fixed anchorage is available, but very often it is not and there is always a risk of a fall ocurring when moving the safety lines from one anchorage point to another.

Accordingly, it has been proposed to manufacture a mobile safety anchor having a housing through which a safety rope can be threaded and a lever via which it may be connected to a safety belt, the housing containing rope-gripping members, wedge means for wedging the rope-gripping members against the rope when the rope-gripping members are lifted due to movement of the lever relative to the runner on fall of a user. Such devices are liable to suffer from orientational instability in use and this may lead to unreliability in operation.

According to the present invention, there is provided a safety device comprising a runner which can be threaded onto a suspended safety line and houses line-gripping means movable between an unlocked condition in which the runner is free to move along said line and a locked condition in which the line is gripped, and operating means which provides externally of the runner an attachment point for a personal safety belt and is operatively associated with said line-gripping means to cause movement thereof towards locked condition responsive to sudden downward acceleration of said attachment point;

with the improvement that said operating means comprises first and second link members each of which is pivotally attached to the runner, and a bar member pivotally connected to said link members to form therewith and with the runner a parallel linkage, and that said attachment point is disposed at least as high as the level of the top of the runner housing when the runner is oriented for use on a vertical line with the operating mechanism in its runner-free position.

This has the advantage of stabilising the orientation of the runner, and allows reliable operation of the device without obstructing movement of the runner along a said safety line during normal use. Furthermore, it enables the device to hang freely from the belt of a user with the runner housing generally vertical which is convenient.

In the following description and in the claims it will be assumed that the runner is oriented for use on a vertical line, and it is intended that references to the top or bottom or to the relative levels of various parts of the device should be construed in that light.

In a preferred embodiment of the invention, the bar member of the parallel linkage is extended above its pivotal connexion points to the said first and second link members, and said attachment point is towards the top of such bar member.

Preferably said attachment point is located on said bar member, and the freedom of movement of the parallel linkage is such that when the operating means and the line-gripping means are in the runner-locked position, the line-gripping means are disposed at least as high as the attachment point. This feature has a further beneficial effect on the stability and reliability of the device.

In the most preferred embodiments of the invention, said operating means comprise a part axially movable within the runner housing under the action of at least one cam member connected to a said link member. This feature has the advantage of positively initiating gripping of a safety line. It is not necessary that movement of said part due to such cam action should in itself be sufficient to bring about firm gripping of the line; it is only necessary that it should urge gripping members into rubbing contact with the line, the final wedging action being caused by frictional interengagement of the line and the gripping members. Such axially movable part can operate to bring about movement of the line-gripping means in part due to its intertia.

The link members of the parallel linkage are preferably arranged substantially symmetrically about a plane containing the axis of the runner.

Said cam action is preferably provided by at least one cam member fixed to at least one end of a said link member which protrudes into said runner housing, such cam member(s) being arranged to bear on a surface of said axially movable part. Advantageously such cam action is provided symmetrically of the runner axis.

Preferably said connexion linkage is spring biased for movement towards the runner-locked position. In cases where at least one cam member is provided as aforesaid, it is preferred that one of the said link members should carry the cam member(s) while the other of such link members is spring loaded to provide said bias. In order to allow free movement of the runner along a safety line in normal use when connected to a user's safety belt as referred to above, the strength of such a spring bias should be such as will be overcome by the weight of the runner housing and the parts contained thereby.

In preferred embodiments of the invention said axially movable part is freely axially movable, that is, it is not spring biased, and preferably also, such part is located in the runner housing between the points of attachment of the link members.

The line-gripping means preferably comprises balls carried by a cage and movable, axially of the runner housing, relative to wedge means. These balls may be carried by a cage separate from the axially movable part responsible for the intitiation of the gripping action, or, and preferably, this axially movable part may itself carry the balls. There are preferably at least three angularly spaced balls which are forced radially inwards against a said safety line by the wedge means in the event of fall of a user of the device.

It is not excluded that the balls or other line-gripping members may normally lie in contact with a said safety line threaded through the runner, provided that frictional forces due to such contact are not sufficient to bring about said relative movement between said wedge means and said gripping members in normal use and in the absence of movement of said connexion linkage from the runner-free to the runner-locked position, and provided also that the gripping members so not effectively grip the safety line until they and the wedge means have been relatively so moved.

The wedge means is preferably fast with the housing of the runner, but it is possible to construct the device so that the locking of the runner onto the safety line takes place by displacement of the wedge means relative to the runner housing and the line-gripping members.

A safety line for use in conjunction with a device according to this invention is suitably a rope which may for example be of wire or synthetic material such as nylon, or it may alternatively be in the form of a rail or rod, depending on the field of use.

Whilst reference has been made to attachment of the runner to a safety belt, it will be appreciated that the runner may of course be attached to any other similar type of personal safety equipment worn by a user, such as a safety harness, and the attachment may be direct or through a rope or other line. The runner is preferably connected to the safety belt or harness directly, e.g. by using a snap link, or by a short flexible line, so that the free-fall distance before the user is arrested is as small as possible.

The main field of application of the invention is safety equipment for use by spidermen or others requiring protection while at work on high structures and during ascent and descent e.g. of high ladders. In such cases the safety line will be secured vertically or steeply inclined. The safety line may for example be a rope freely suspended from a high anchorage point. In that case a workman wearing a safety belt or harness attached to the runner will be able to move up and down and over appreciable distances at any given level, and the great advantage is realised due to this invention that at no time during such movements need the safety line anchorgage be shifted or the worker's connexion to the safety line be released, and in the event of a fall the runner grips the safety line without any substantial displacement therealong as soon as a sudden pull is exerted on the connexion linkage due to such fall.

For high ladder work, the safety line, e.g. in the form of a rod or rail or rope, may be secured to top and bottom anchorages on or adjacent the ladder, preferably at one side thereof in a position such as might be occupied by a hand rail. The safety line, with a runner thereon can remain in place as a permanent installation (subject only to periodical inspection if desired) so that it is ready for use by a workman as soon as he reaches the ladder. He has merely to attach his safety belt or harness to the connexion means of the runner.

A preferred embodiment of the present invention will now be described by way of example with reference to the accompanying diagrammatic drawings, in which.

Figure 1:
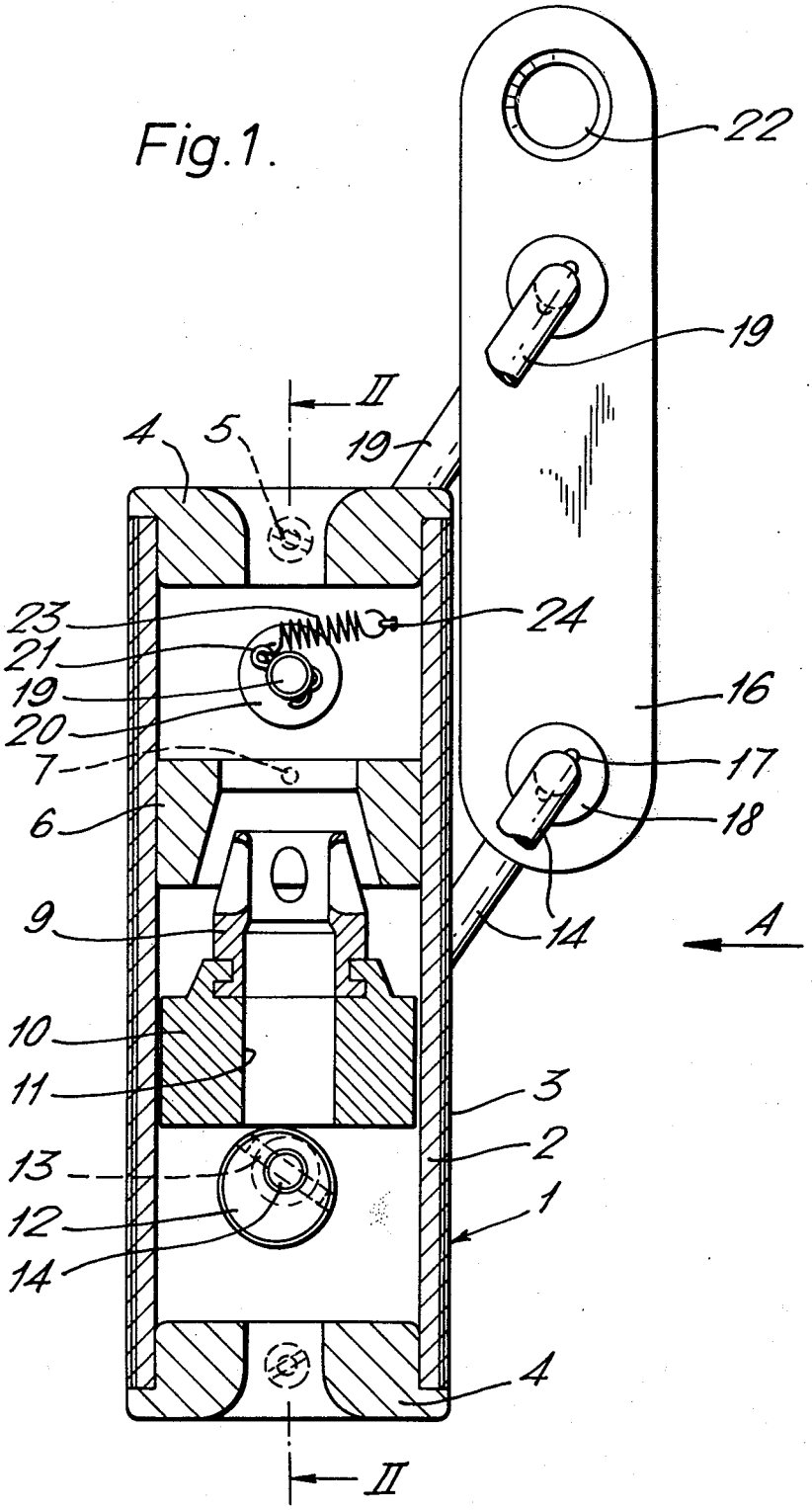
FIG. 1 is a side view partly in cross section of a runner and connexion linkage constituting a safety device according to the invention in condition to run freely along a safety line, that is, with the connexion linkage in the runner-free position.

In the drawings, the runner generally indicated at 1 comprises a cylindrical housing 2 suitably of steel with a synthetic plastics sheath 3, e.g. of polyethylene. Guide blocks 4 which may be jam fitted into each end of the housing 2 and secured by screws 5 partially close each end of the housing and define a central passageway through which a safety line (not shown) may be threaded.

A wedging ring 6 which has a generally conical bore is secured within the housing by pins 7. Safety line gripping members constituted as balls 8 (not shown in FIG. 1) are carried by a cage portion 9 of an axially movable part 10 which is displaceable relative to the ring 6 so that the balls 8 can move along the conical bore of that ring to wedge against and grip a safety line threaded through the guide blocks 4 and through an axial hole 11 in the movable part 10. (See especially FIG. 3).

This relative displacement of the wedging ring 6 and the gripping members 8 is initiated by the action of cams 12 fixed e.g. by pins 13 to the ends of a lower loop link member 14 which protrude into the housing 2 through diametrically opposed holes 15 (FIG. 2) so that such loop link member is pivotally attached to the housing of the runner. This lower loop link member passes through a hole towards the lower end of a bar member 16, and the lower link member is pinched up at 17 to retain the bar member 16 at a position remote from the runner. Washers 18 are provided between the pinches 17 and the bar member 16. The bar member 16 is likewise held by an upper loop link member 19 whose ends project through holes in the housing 2 in the same axial plane as the holes 15. The ends of the upper link member 19 are secured for pivotal movement by washers 20 held in place by split pins 21. A hole 22 is formed in the bar member 16 to serves as an attachment point for a safety belt or harness. It will be noted that in the runner-free position shown in FIG. 1, the hole 22 is above the level of the top of the runner housing and that in the runner-locked position (FIG. 3) such hole is below the level of the line gripping balls 8.

A spring 23 is attached between one or each of the split pins 21 and an anchoring point e.g. another split pin 24, on the housing 2, so as to bias the parallel linkage formed by the runner housing, the upper and lower link members 19 and 14 and the bar member 16 for downward pivotal movement.

Figure 2:
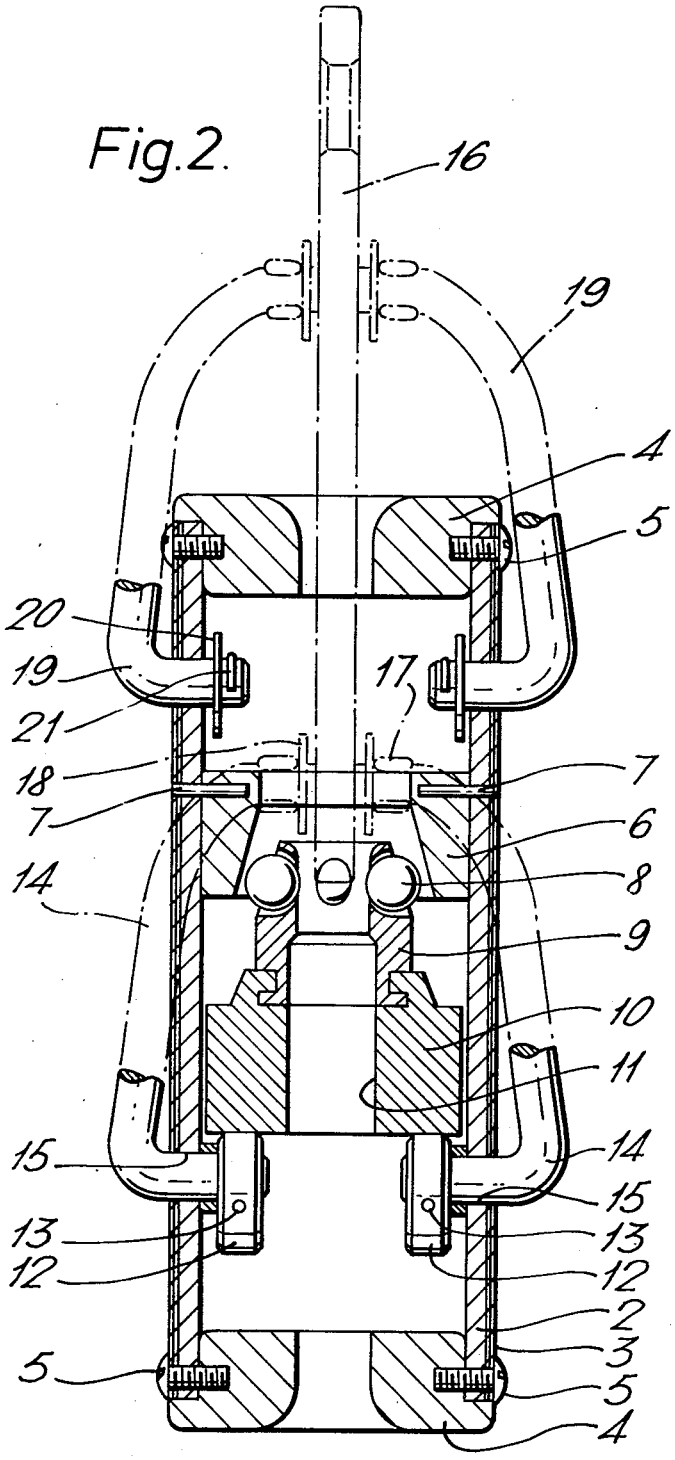
FIG. 2 is a view in the direction of arrow A of FIG. 1 and showing the runner in cross section along the line II—II.
Figure 3:
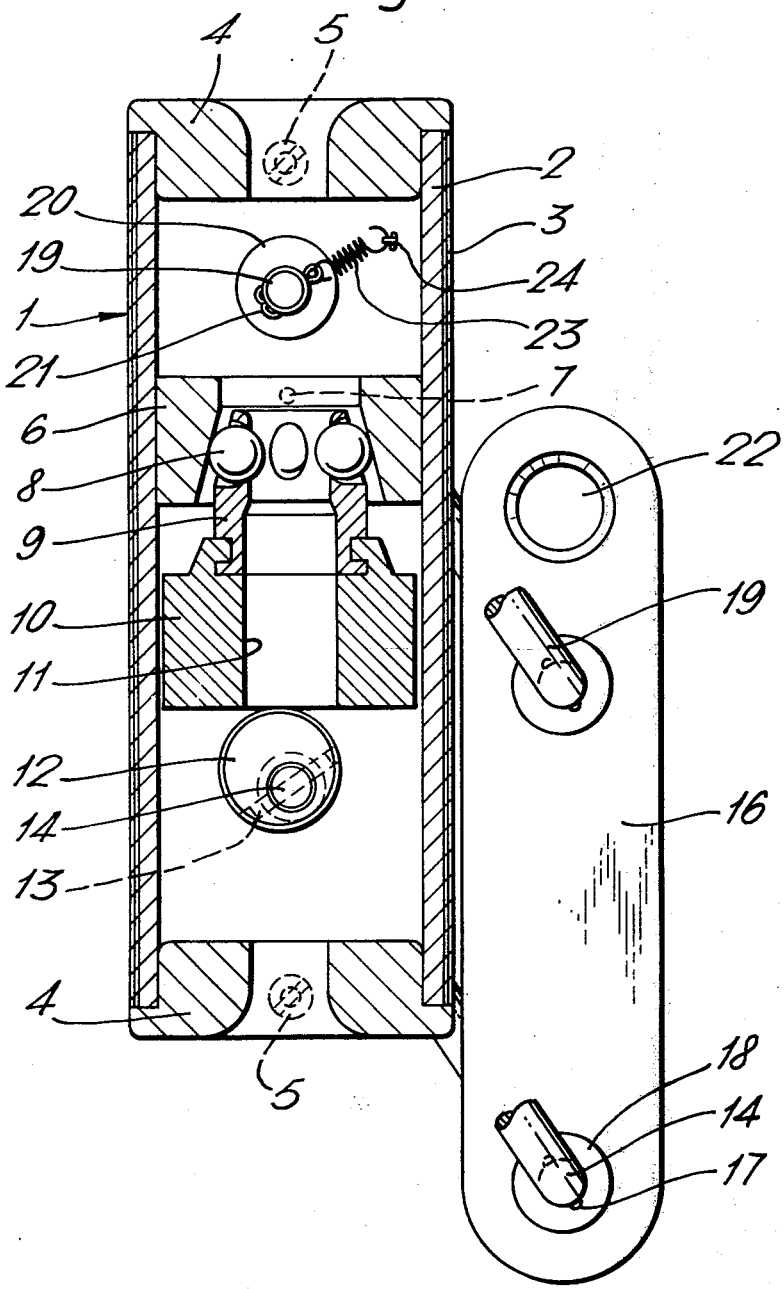
FIG. 3 is a view corresponding to FIG. 1 of the device in condition to grip a safety line that is, with the connexion linkage in the runner-locked position.

In use, a safety line (not shown) is threaded through the runner 1 and the bar member 16 is attached to a safety belt using the hole 22, so that the device hangs from the belt in the condition shown in FIG. 1 when it can slider freely up and down the line. Should the user fall however, the bar member 16 will rapidly accelerate downwards with respect to the runner, (this relative acceleration being augmented by the action of the spring 23) and the device will enter the condition shown in FIG. 3. By virtue of the downward pivotal movement of the lower link member 14, cams 12 will be rotated and lift the axially movable part 10 within the housing. It will be noted that the cam action on the lower end surface of the axially movable part 10 is substantially symmetrical of the axis of the runner. Lifting of the axially movable part 10 causes the line-gripping balls 8 to be urged radially inwardly as they rise within the conical bore of the wedging ring 6 into at least rubbing engagement with the safety line (not shown). Frictional contact between the line and the balls tends to force them even further up the conical bore than is shown in FIG. 3 so that they grip a line even more firmly.

The grip on the safety line may be released simply by returning the connexion linkage to the position shown in FIG. 1 and pulling the runner up the safety line for a short distance.

It will of course be appreciated that for correct operation of the device specifically described above, the size of the line-gripping balls 8 and the size and conicity of the bore of the wedging ring 6 must be chosen with a particular size of safety line in mind, and that the device should only be used in conjunction with a line of substantially uniform diameter. In any particular case, if the safety line is too thin, then the device will fail to grip even on fall of a user, and if the line is too thick, it may be impossible to slide the runner along the line even in normal descent.

I claim:

1. A safety device comprising a runner which can be threaded onto a suspended safety line and houses line-gripping means movable between an unlocked condition in which the runner is free to move along said line and a locked condition in which the line is gripped, and operating means which provides externally of the runner an attachment point for a personal safety belt and is operatively associated with said line-gripping means to cause movement thereof towards locked condition responsive to sudden downward acceleration of said attachment point; with the improvement that said operating means comprises first and second link members each of which is pivotally attached to the runner, and a bar member pivotally connected to said link members to form therewith and with the runner a parallel linkage, and that said attachment point is disposed at least as high as the level of the top of the runner housing when the runner is oriented for use on a vertical line with the operating mechanism in its runner-free position.

2. A safety device according to claim 1, wherein the bar member of the parallel linkage is extended above its pivotal connection to the said first and second link members, and said attachment point is towards the top of such bar member.

3. A safety device according to claim 1, wherein said attachment point is located on said bar member, and the freedom of movement of the parallel linkage is such that when the operating means and the line-gripping means are in the runner-locked position, the line-gripping means are disposed at least as high as the attachment point.

4. A safety device according to claim 1, wherein the link members of the parallel linkage are arranged substantially symmetrically about a plane containing the axis of the runner.

5. A safety device according to claim 1, wherein said operating means comprise a part axially movable within the runner housing under the action of at least one cam member connected to a said link member.

6. A safety device according to claim 5, wherein said cam action is provided by at least one cam member fixed to at least one end of a said link member which protrudes into said runner housing, such cam member being arranged to bear on a surface of said axially movable part.

7. A safety device according to claim 6, wherein such cam action is provided symmetrically of the runner axis.

8. A safety device according to claim 6, wherein one of the said link members carries the cam member while the other of such link members is spring loaded to bias the linkage for movement towards the runner-locked position.

9. A safety device according to claim 5, wherein said axially movable part is freely axially movable and such part is located in the runner housing between the points of attachment of the link members.

10. A safety device according to claim 1, wherein the line-gripping means comprises balls carried by a cage and movable, axially of the runner housing, relative to wedge means fast with such housing.

* * * * *